US010869504B2

(12) United States Patent
Mironov et al.

(10) Patent No.: US 10,869,504 B2
(45) Date of Patent: Dec. 22, 2020

(54) AEROSOL-GENERATING SYSTEM AND AEROSOL-GENERATING ARTICLE FOR USE IN SUCH A SYSTEM

(71) Applicant: PHILIP MORRIS PRODUCTS S.A., Neuchatel (CH)

(72) Inventors: Oleg Mironov, Cudrefin (CH); Ihar Nikolaevich Zinovik, Peseux (CH); Oleg Fursa, Gempenach (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 318 days.

(21) Appl. No.: 15/751,906

(22) PCT Filed: Aug. 16, 2016

(86) PCT No.: PCT/EP2016/069362
§ 371 (c)(1),
(2) Date: Feb. 12, 2018

(87) PCT Pub. No.: WO2017/029270
PCT Pub. Date: Feb. 23, 2017

(65) Prior Publication Data

US 2018/0228217 A1 Aug. 16, 2018

(30) Foreign Application Priority Data

Aug. 17, 2015 (EP) ..... 15181196

(51) Int. Cl.
*A24F 47/00* (2020.01)
*A24B 15/16* (2020.01)
(Continued)

(52) U.S. Cl.
CPC ..... *A24F 47/008* (2013.01); *A24B 15/167* (2016.11); *F22B 1/281* (2013.01)

(58) Field of Classification Search
CPC ..... A24B 15/167; A24F 47/008; F22B 1/281
See application file for complete search history.

(56) References Cited

U.S. PATENT DOCUMENTS 5,613,505 A 3/1997 Campbell et al.
10,028,533 B2 * 7/2018 Fursa ..... H05B 6/06
(Continued)

FOREIGN PATENT DOCUMENTS

CN 204519365 U 8/2015
EP 2444112 4/2012
(Continued)

OTHER PUBLICATIONS

PCT Search Report and Written Opinion for PCT/EP2016/069362 dated Oct. 31, 2016 (11 pages).
(Continued)

*Primary Examiner* — Frederick C Nicolas
(74) *Attorney, Agent, or Firm* — Oblon, McClelland, Maier & Neustadt, L.L.P.

(57) ABSTRACT

An aerosol-generating system includes two substance sources, including a nicotine source and a second substance source, and a susceptor for heating any one of the two substance sources. The system also includes a power source connected to a load network, the load network including an inductor for being inductively coupled to the susceptor. The two substance sources are thermally coupled such that the other one of the two substance sources not heated by the susceptor is heatable by heat transfer from the one of the two substance sources that is heated by the susceptor. An aerosol-generating article includes a cartridge including a first compartment and a second compartment source, and a susceptor is arranged in any one of the first compartment or the second compartment.

19 Claims, 1 Drawing Sheet

(51) Int. Cl.
*F22B 1/28* (2006.01)
*A24B 15/167* (2020.01)

(56) References Cited

U.S. PATENT DOCUMENTS

| | | | | |
|---|---|---|---|---|
| 10,251,423 | B2 * | 4/2019 | Mamoun | G05B 15/02 |
| 10,334,883 | B2 * | 7/2019 | Silvestrini | A61M 15/0003 |
| 2015/0245669 | A1 * | 9/2015 | Cadieux | A24F 40/465 131/329 |
| 2016/0219938 | A1 * | 8/2016 | Mamoun | G05B 15/02 |
| 2017/0055585 | A1 * | 3/2017 | Fursa | H05B 6/04 |
| 2017/0196269 | A1 * | 7/2017 | Bernauer | A24F 47/008 |
| 2018/0168226 | A1 * | 6/2018 | Mironov | A24F 47/008 |
| 2018/0184713 | A1 * | 7/2018 | Mironov | A24F 47/008 |
| 2018/0192700 | A1 * | 7/2018 | Fraser | A24F 47/008 |
| 2018/0228217 | A1 * | 8/2018 | Mironov | A24B 15/167 |
| 2018/0271152 | A1 * | 9/2018 | Silvestrini | A61M 15/0003 |

FOREIGN PATENT DOCUMENTS

| | | | |
|---|---|---|---|
| WO | | 2014/045025 | A2 | 3/2014 |
| WO | WO | 2014/048745 | | 4/2014 |
| WO | | 2014/140320 | A1 | 9/2014 |
| WO | WO | 2015/000974 | | 1/2015 |
| WO | | 2015/040180 | A2 | 3/2015 |
| WO | WO | 2015/038981 | | 3/2015 |

OTHER PUBLICATIONS

International Preliminary Report on Patentability for PCT/EP2016/069362 dated Oct. 31, 2017 (14 pages).
Office Action issued in China for Application No. 201680043152.7 dated Apr. 15, 2020 (17 pages). English translation included.
Notice of Reasons for Refusal dated Sep. 7, 2020 in corresponding Japanese Patent Application No. 2018-504915 (with English translation) (7 pages).

* cited by examiner

AEROSOL-GENERATING SYSTEM AND AEROSOL-GENERATING ARTICLE FOR USE IN SUCH A SYSTEM

This application is a U.S. National Stage Application of International Application No. PCT/EP2016/069362, filed Aug. 16, 2016, which was published in English on Feb. 23, 2017, as International Publication No. WO2017/029270 A1. International Application No. PCT/EP2016/069362 claims priority to European Application No. 15181196.5 filed Aug. 17, 2015.

BACKGROUND

The invention relates to inductively heated aerosol-generating systems comprising a nicotine source for generating an aerosol comprising nicotine. The invention also relates to an aerosol-generating article comprising a nicotine source for use in such an aerosol-generating system. Yet further, the invention relates to a method for controlling the reaction stoichiometry between nicotine vapour and the vapour of a second substance.

Various aerosol-generating systems and devices for delivering nicotine to a user from a nicotine source are known. Therein, a heating element heats the nicotine source and a delivery enhancing compound. Differences in vapour pressure of the two compounds may lead to an unfavourable reaction stoichiometry. To improve reaction a delivery enhancing compound having a similar vapour pressure than nicotine may be selected. However, this limits the choice in compounds to be used in combination with nicotine.

Thus there is need for an aerosol-generating system comprising a nicotine source having an improved heating mechanism. In particular, there is need for such an aerosol-generating system and an aerosol-generating article to be used in such a system that enable an efficient reaction stoichiometry and preferably consistent aerosol formation and that is adaptable to compounds having different vapour pressures.

BRIEF SUMMARY

According to an aspect of the invention, there is provided an aerosol-generating system. The aerosol-generating system comprises two substance sources including a nicotine source and a second substance source. The system further comprises a susceptor, preferably a single susceptor, for heating one of the two substance sources. A power source of the system is connected to a load network. The load network comprises an inductor for being inductively coupled to the susceptor. The two substance sources are thermally coupled such that the other one of the two substance sources, which is not heated by the susceptor, is heatable by heat transfer from the one of the two substance sources that is heated by the susceptor. While one substance is heated directly by the susceptor, the other substance is heated through heat transfer from the one substance that is heated by the susceptor.

In the aerosol-generating system, the two substance sources are both heatable to temperatures for substance evaporation. Preferably, the two substance sources are heatable to individual temperatures, which individual temperature lie above desired temperatures for substance evaporation for each of the respective substance sources.

By providing one source only with a susceptor, both substances of the two sources may be heated and may be heated to individual temperatures. However, one heating element only is provided and operation of one heating element only is required, which reduces complexity and manufacturing cost of the system according to the invention.

The susceptor may be adapted and designed for heating either the nicotine source or the second substance source.

The system is configured such that heating is performed in a manner to preferably generate an efficient reaction stoichiometry of the nicotine vapour and of the vapour of the second substance to produce aerosol. The susceptor and a thermal coupling, that is, heat transfer, may be configured such that heating is performed in a manner to provide a consistent nicotine delivery to a user. Preferably, no unreacted nicotine vapour or unreacted second substance vapour is delivered to a user.

The susceptor may be configured to heat the one of the two substance sources to a first temperature. Additionally, a thermal coupling of the two substance sources may be configured such that the other one of the two substance sources not heated by the susceptor may be heated by heat transfer to a second temperature. Therein, the first temperature and the second temperature may be identical but in general are different. Preferably, the second temperature is lower than the first temperature. The first and second temperature may be such as to vaporize a desired amount of nicotine and to vaporize a desired amount of the second substance such as to achieve an efficient reaction stoichiometry. Preferably, the susceptor is used to heat the substance source requiring higher temperatures for vapour generation. Depending on evaporation temperatures and vapour pressures of the two substance sources, the susceptor may be used to heat the nicotine source or to heat the second substance source. The susceptor may be used to heat the substance source, which is more heat resistant and less prone to overheating or burning.

Due to different temperatures achievable for the nicotine source and the second substance source, a combination of substances may be chosen for aerosol generation, wherein the substances have different vapour pressures. Thus more flexibility and variation may be provided in aerosol formation.

The susceptor may be in direct contact, preferably in direct physical contact, with either one of the nicotine source or the second substance source. Preferably, the susceptor is in direct contact, preferably in direct physical contact, with either the nicotine source or the second substance source. When the susceptor is in contact with one source, the susceptor is not in contact with the other source.

A direct contact, in particular a direct physical contact, may reduce or entirely omit thermal losses between heating element and source to be heated. Thus, a direct contact may provide a very efficient heating of a substance source.

As used herein, the term "susceptor" refers to a material that is capable to convert electromagnetic energy into heat. When located in an alternating electromagnetic field, typically eddy currents are induced and hysteresis losses occur in the susceptor causing heating of the susceptor. As the susceptor is located at least in thermal contact or close thermal proximity with the nicotine source or the second substance source, the respective sources are heated by the susceptor such that a vapour is formed. Preferably, the susceptor is arranged in direct physical contact with the respective source.

The susceptor may be formed from any material that can be inductively heated to a temperature sufficient to vaporize nicotine and the second substance. Preferred susceptors comprise a metal or carbon. A preferred susceptor may comprise or consist of a ferromagnetic material, for example ferritic iron or a ferromagnetic alloy, such as a ferromagnetic steel or stainless steel. A preferred susceptor may comprise or consist of a ferrite. A suitable susceptor may comprise aluminium. The susceptor preferably comprises more than 5%, preferably more than 20%, preferably more than 50% or 90% of ferromagnetic or paramagnetic materials.

Preferred susceptors may be heated to a temperature in excess of 50 degrees Celsius. In use with the system according to the invention, susceptors may be heated to temperatures in preferred ranges of: 30 and 150 degree Celsius, 35 and 140 degree Celsius, 45 and 130 degree Celsius, 65 and 120 degree Celsius, and 80 and 110 degree Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

A susceptor may be a metallic elongate material.

A susceptor may be in the form of a filament, rod, sheet or band.

A susceptor may be solid, hollow or porous. Preferably, a susceptor is solid.

A susceptor may be a carrier for the nicotine or the second substance source. For example, nicotine or a second substance may be loaded onto or in the susceptor. For example, a susceptor may be sponge-like material, for example, a metallic sponge.

If a susceptor profile is of constant cross-section, for example a circular cross-section, it has a preferable width or diameter of between about 1 millimeter and about 5 millimeter. If the susceptor profile has the form of a sheet or band, the sheet or band preferably has a rectangular shape having a width preferably between about 2 millimeter and about 8 millimeter, more preferably, between about 3 millimeter and about 5 millimeter, for example 4 millimeter and a thickness preferably between about 0.03 millimeter and about 0.15 millimeter, more preferably between about 0.05 millimeter and about 0.09 millimeter, for example about 0.07 millimeter.

As a general rule, whenever the term "about" is used in connection with a particular value throughout this application this is to be understood such that the value following the term "about" does not have to be exactly the particular value due to technical considerations. However, the term "about" used in connection with a particular value is always to be understood to include and also to explicitly disclose the particular value following the term "about".

The nicotine source may comprise one or more of nicotine, nicotine base, a nicotine salt, such as nicotine-HCl, nicotine-bitartrate, or nicotine-ditartrate, or a nicotine derivative. The nicotine source may comprise natural nicotine or synthetic nicotine. The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof. For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulphate and combinations thereof.

The nicotine source may comprise an aqueous solution of nicotine, nicotine base, a nicotine salt or a nicotine derivative and an electrolyte forming compound.

The nicotine source may further comprise other components including, but not limited to, natural flavours, artificial flavours and antioxidants.

The nicotine source may comprise a sorption element and nicotine sorbed on the sorption element. If the susceptor is to heat the nicotine source, preferably, the susceptor is in physical contact with the sorption element. For example, the susceptor may be embedded in the sorption element.

The sorption element may be formed from any suitable material or combination of materials. For example, the sorption element may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

The sorption element may be a porous sorption element. For example, the sorption element may be a porous sorption element comprising one or more materials selected from the group consisting of porous plastic materials, porous polymer fibres and porous glass fibres.

The sorption element is preferably chemically inert with respect to nicotine.

The sorption element may have any suitable size and shape.

In certain embodiments the sorption element may be a substantially cylindrical plug. For example, the sorption element may be a porous substantially cylindrical plug.

In other embodiments the sorption element may be a substantially cylindrical hollow tube. For example, the sorption element may be a porous substantially cylindrical hollow tube.

The size, shape and composition of the sorption element may be chosen to allow a desired amount of nicotine to be sorbed on the sorption element.

The sorption element advantageously acts as a reservoir for the nicotine.

The second substance is a delivery enhancing compound or substance to react with nicotine vapour. The nicotine vapour reacts with the second substance vapour in the gas phase to form an aerosol. The formed aerosol is delivered to a downstream end of an aerosol-generating article and to a user.

The delivery enhancing compound may be an acid. The delivery enhancing compound may be an acid selected from the group consisting of 3-methyl-2-oxovaleric acid, pyruvic acid, 2-oxovaleric acid, 4-methyl-2-oxovaleric acid, 3-methyl-2-oxobutanoic acid, 2-oxooctanoic acid, 2-oxopropanoic acid (lactic acid) and combinations thereof. Preferably, the delivery enhancing compound is pyruvic acid or lactic acid.

The second substance source, for example comprising a pyruvic acid source or a lactic acid source, may comprise a sorption element and a second substance, for example lactic acid, sorbed on the sorption element. If the susceptor is to heat the second substance source, preferably, the susceptor is in physical contact with the sorption element. For example, the susceptor may be embedded in the sorption element.

The sorption element may be formed from any suitable material or combination of materials, for example those listed above.

The sorption element is preferably chemically inert with respect to the second substance.

The sorption element may have any suitable size and shape.

The sorption element for the second substance may have a same form, material and size as described above for the sorption element for the nicotine. In particular, the two sorption elements may be identical.

The size, shape and composition of the sorption element may be chosen to allow a desired amount of second substance to be sorbed on the sorption element.

The sorption element advantageously acts as a reservoir for the second substance.

Preferably, the second substance source comprises a lactic acid source or pyruvic acid source and an aerosol in the aerosol-generating system comprises nicotine salt particles. The nicotine salt particles may be nicotine lactate acid salt particles or nicotine pyruvate salt particles.

With the aerosol-generating system and the aerosol-generating article according to the present invention advantageously allows an efficient reaction stoichiometry to be achieved by heating the nicotine source and the second substance source to different temperatures and additionally or alternatively at different paces using a single susceptor. As described and illustrated further below, this enables the nicotine source and the second substance source to be stored and heated in two compartments in a single component within the aerosol-generating system and the aerosol-generating article according to the present invention. This advantageously reduces the complexity and cost of manufacturing the aerosol-generating system and the aerosol-generating article according to the present invention.

Heating the nicotine source and the second substance source to a temperature above ambient temperature using a single susceptor allows control of the amount of nicotine vapour and vapour of second substance acid released from the nicotine source and the second substance source, respectively. This advantageously enables the vapour concentrations of the nicotine and the second substance to be controlled and balanced proportionally to yield an efficient reaction stoichiometry. This advantageously improves the efficiency of the formation of an aerosol and the consistency of nicotine delivery to a user. It also advantageously reduces the risk of undesired delivery of excess reactant to a user.

Preferably, the aerosol-generating system according to the present invention comprises a proximal end through which, in use, an aerosol exits the aerosol-generating system for delivery to a user. The proximal end may also be referred to as the mouth end. In use, preferably a user draws on the proximal end of the aerosol-generating system. The aerosol-generating system preferably comprises a distal end opposed to the proximal end.

Typically when a user draws on the proximal end of the aerosol-generating system, air is drawn into the aerosol-generating system, passes through the aerosol-generating system and exits the aerosol-generating system at the proximal end. Components, or portions of components, of the aerosol-generating system may be described as being upstream or downstream of one another based on their relative positions between the proximal end and the distal end of the aerosol-generating system.

As used herein, the terms "upstream", "downstream", "proximal" and "distal" are used to describe the relative positions of components, or portions of components, of the aerosol-generating system and the aerosol-generating article according to the invention.

The aerosol-generating system according to the invention may comprise an aerosol-generating article. In general, an aerosol-generating article is introduced into a cavity of an inductive heating device of the aerosol-generating system such that heat may be induced in the susceptor by a corresponding inductor of a power supply electronics arranged in the inductive heating device. The aerosol-generating article comprised in the aerosol-generating system may be as described below.

According to one aspect, the invention relates to an aerosol generating article. The aerosol-generating article comprises a cartridge comprising a first compartment comprising the nicotine source and a second compartment comprising the second substance source. The susceptor is arranged in any one of the first compartment or the second compartment.

As used herein, the term "first compartment" is used to describe one or more chambers or containers within the aerosol-generating article comprising the nicotine source.

As used herein, the term "second compartment" is used to describe one or more chambers or containers within the aerosol-generating article comprising the second substance source.

The first compartment and the second compartment may abut one another. Alternatively, the first compartment and the second compartment may be spaced apart from one another.

In use, typically nicotine vapour is released from the nicotine source in the first compartment and second substance vapour is released from the second substance source in the second compartment. The nicotine vapour reacts with the second substance vapour in the gas phase to form an aerosol, which is delivered to a user. Preferably, the aerosol-generating system according to the present invention further comprises a reaction chamber downstream of the first compartment and the second compartment configured to facilitate reaction between the nicotine vapour and the second substance vapour. The aerosol-generating article may comprise the reaction chamber. Where the aerosol-generating device comprises a device housing and a mouthpiece portion, the mouthpiece portion of the aerosol-generating device may comprise the reaction chamber.

As described further below, the first compartment and the second compartment may be arranged in series or parallel within the aerosol-generating article. Preferably, the first compartment and the second compartment are arranged in parallel within the cartridge.

By "series" it is meant that the first compartment and the second compartment are arranged within the aerosol-generating article so that in use an air stream drawn through the aerosol-generating article passes through one of the first compartment and the second compartment and then passes through the other of the first compartment and the second compartment. Nicotine vapour is released from the nicotine source in the first compartment into the air stream drawn through the aerosol-generating article and second substance vapour is released from the second substance source in the second compartment into the air stream drawn through the aerosol-generating article. The nicotine vapour reacts with the second substance vapour in the gas phase to form an aerosol, which is delivered to a user.

As used herein, by "parallel" it is meant that the first compartment and the second compartment are arranged within the aerosol-generating article so that in use a first air stream drawn through the aerosol-generating article passes through the first compartment and a second air stream drawn through the aerosol-generating article passes through the second compartment. Nicotine vapour is released from the nicotine source in the first compartment into the first air stream drawn through the aerosol-generating article and second substance vapour is released from the second substance source in the second compartment into the second air stream drawn through the aerosol-generating article. The nicotine vapour in the first air stream reacts with the second substance vapour in the second air stream in the gas phase to form an aerosol, which is delivered to a user.

The cartridge may further comprise a third compartment, preferably comprising an aerosol-modifying agent source. The first compartment, the second compartment and the third compartment are preferably arranged in parallel within the cartridge.

Where the aerosol-generating article comprises a third compartment, the third compartment may comprise one or more aerosol-modifying agents. For example, the third compartment may comprise one or more sorbents, such as activated carbon, one or more flavourants, such as menthol, or a combination thereof. A third compartment may also comprise an additional nicotine source. Preferably, the aerosol-modifying agent source in the third compartment is heated through heat transfer from the first or second compartment the susceptor is arranged in. The aerosol-modifying agent may be sorbed on a sorption element arranged in the third compartment.

The cartridge of the aerosol-generating article may have any suitable shape. Preferably, the cartridge may be substantially cylindrical. The first compartment, the second compartment and, where present, the third compartment preferably extend longitudinally between the opposed substantially planar end faces of the cartridge.

One or both of the opposed substantially planar end faces of the cartridge may be sealed by one or more frangible or removable barriers.

One or both of the first or second compartment comprising the nicotine source and the second compartment comprising the second substance source may be sealed by one or more frangible barriers. The one or more frangible barriers may be formed from any suitable material. For example, the one or more frangible barriers may be formed from a metal foil or film.

Preferably, the frangible barrier is formed of a material comprising no, or a limited amount of ferromagnetic material or paramagnetic material. In particular, the frangible barrier may comprise less than 20 percent, in particular less than 10 percent or less than 5 percent or less than 2 percent of ferromagnetic or paramagnetic material.

The aerosol-generating device preferably further comprises a piercing member configured to rupture the one or more frangible barriers sealing one or both of the first compartment and the second compartment. One or both of the first compartment comprising the nicotine source and the second compartment comprising the second substance source may be sealed by one or more removable barriers. For example, one or both of the first compartment comprising the nicotine source and the second compartment comprising the second substance source may be sealed by one or more peel-off seals.

The one or more removable barriers may be formed from any suitable material. For example, the one or more removable barriers may be formed from a metal foil or film.

The cartridge may have any suitable size. The cartridge may have a length of, for example, between about 5 mm and about 30 mm. In certain embodiments the cartridge may have a length of about 20 mm. The cartridge may have a diameter of, for example, between about 4 mm and about 10 mm. In certain embodiments the cartridge may have a diameter of about 7 mm. As used herein with reference to the present invention, by "length" is meant the maximum longitudinal dimension between the distal end and the proximal end of components, or portions of components, of the aerosol-generating system.

According to another aspect of the present invention, there is provided an aerosol-generating article for use in an aerosol-generating system according to the invention. The aerosol-generating article comprises a cartridge. The cartridge comprises a first compartment comprising a nicotine source and a second compartment comprising a second substance source. A susceptor is arranged in any one of the first compartment or the second compartment. Preferably, the susceptor is arranged in the compartment containing the substance having a lower vapour pressure.

Preferably, the susceptor is arranged in a central portion of the first compartment or the second compartment.

A central arrangement may be favorable in view of heat distribution in the compartment and, for example in the material provided in the compartment, for example a sorption element. A central arrangement may, for example, be favorable for a homogeneous or symmetric heat distribution in the compartment or in a source provided in the compartment, respectively. Heat generated in the central portion may dissipate in radial direction and heat-up a source around an entire circumference of the susceptor.

Preferably, a central portion is a region of the compartment or of the source provided in the compartment encompassing a central axis of a compartment. The susceptor may be arranged substantially longitudinally within the compartment or within a source in the compartment. This means that a length dimension of the susceptor is arranged to be approximately parallel to a longitudinal direction of the compartment, for example within plus or minus 10 degrees of parallel to the longitudinal direction of the compartment. With an arrangement of the susceptor in a central portion of the respective compartment, a contact of the susceptor with an outer cartridge wall may be avoided. Thus, undesired heating of a cartridge wall and heat dissipation out of the cartridge may thus be limited.

As used herein with reference to the present invention, the term "longitudinal" is used to describe the direction between the proximal end and the opposed distal end of the aerosol generating system or the aerosol-generating article, accordingly.

As used herein, by "length" is meant the maximum longitudinal dimension between the distal end and the proximal end of components, or portions of components, of the aerosol-generating system.

The cartridge comprises a separation wall, separating the first compartment from the second compartment. The separation wall comprises or is made of thermally conductive material. Preferably, the separation wall is made of thermally conductive material.

Thermal conductivity is of a material to conduct heat. Heat transfer occurs at a lower rate across materials of low thermal conductivity than across materials of high thermal conductivity. The thermal conductivity of a material may depend on temperature.

Thermally conductive materials as used in the present invention, in particular for cartridge materials, preferably have thermal conductivities of more than 10 Watt per (meter×Kelvin), preferably more than 100 Watt per (meter×Kelvin), for example between 10 and 500 Watt per (meter×Kelvin).

Suitable thermally conductive materials include, but are not limited to, metals such as, for example, aluminium. chromium, copper, gold, iron, nickel and silver, alloys, such as brass and steel and combinations thereof. Thermally conductive material is favourable in view of heat transfer from one compartment to the other compartment and in view of heat distribution. By thermally conductive material arranged between the two compartments, a thermal coupling between the two substances in the two compartments maybe supported. Thermally conductive material may also support a homogenous heat temperature distribution in the compartments.

A separation wall may be arranged on a symmetry axis of the cartridge. In such embodiments, a first compartment and a second compartment is identical in size and shape.

The susceptor may be an elongate susceptor, preferably in the shape of a susceptor rod. The susceptor may be arranged in the vicinity or adjacent a separation wall for more direct heat transfer through the separation wall.

The cartridge or parts of the cartridge may be formed from one or more suitable materials. Suitable materials include, but are not limited to, aluminium, polyether ether ketone (PEEK), polyimides, such as Kapton®, polyethylene terephthalate (PET), polyethylene (PE), polypropylene (PP), polystyrene (PS), fluorinated ethylene propylene (FEP), polytetrafluoroethylene (PTFE), epoxy resins, polyurethane resins and vinyl resins.

Preferably, the cartridge is formed of a material comprising no, or a limited amount of ferromagnetic or paramagnetic material. In particular, the cartridge may comprise less than 20 percent, in particular less than 10 percent or less than 5 percent or less than 2 percent of ferromagnetic or paramagnetic material.

The cartridge may be formed from one or more materials that are nicotine-resistant and resistance to the second substance, for example, lactic acid-resistant or pyruvic acid-resistant.

The first compartment comprising the nicotine source may be coated with one or more nicotine-resistant materials and the second compartment comprising the second substance source may be coated with one or more second substance-resistant, for example, lactic acid-resistant or pyruvic acid-resistant materials.

Examples of suitable nicotine-resistant materials and acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more nicotine-resistant materials and second substance-resistant materials to form the cartridge or coat the interior of the first compartment and the second compartment, respectively, may advantageously enhance the shelf life of the aerosol-generating article.

An outer cartridge wall may comprise thermally conductive or thermally insulating material. A thermally conductive material may support a homogeneous heat distribution in a compartment. An outer cartridge wall made of thermally insulating material on the other hand may be favourable in view of energy consumption of the system. It may also be favourable in view of a more convenient handling of such a system. Through a thermal insulation, heat generated in the cartridge is kept in the cartridge. Less or no heat loss to the environment is available through heat conduction. In addition, a heating up of a housing of an aerosol-generating device may be limited or avoided.

If the outer cartridge wall is formed from one or more thermally insulating materials, the interior of the first compartment and the second compartment may be coated with one or more thermally conductive materials to improve heat distribution in the respective compartments.

Use of one or more thermally conductive materials to coat the interior of the first compartment and the second compartment advantageously increases heat transfer from the susceptor to the nicotine source and the second substance source.

Thermally insulating materials as used in the present invention, in particular for cartridge materials, preferably have thermal conductivities of less than 1 Watt per (meter×Kelvin), preferably less than 0.1 Watt per (meter×Kelvin), for example between 1 and 0.01 Watt per (meter×Kelvin).

Cartridges for use in aerosol-generating systems according to the present invention and aerosol-generating articles according to the present invention may be formed by any suitable method. Suitable methods include, but are not limited to, deep drawing, injection moulding, blistering, blow forming and extrusion.

The aerosol-generating article may comprise a mouthpiece. The mouthpiece may comprise a filter. The filter may have a low particulate filtration efficiency or very low particulate filtration efficiency. The mouthpiece may comprise a hollow tube. The mouthpiece of the aerosol-generating article or of an aerosol-generating device may comprise a reaction chamber.

According to an aspect of the present invention, there is provided a method for controlling the reaction stoichiometry between nicotine vapour and a second substance vapour in an aerosol-generating system for the in situ generation of aerosol comprising nicotine. The method comprises the step of providing two substances including nicotine and a second substance. The method further comprises the steps of providing a susceptor and heating one of the two substances to a first temperature by the susceptor. A temperature gradient is generated between the two substances such that heating the other one of the two substances to a second temperature through heat transfer from the one substance heated by the susceptor may be performed. Preferably, the second temperature is lower than the first temperature. In a further step of the method according to the invention, the ratio of a vaporized amount of nicotine and vaporized amount of second substance is controlled.

Preferably, a controlling of the ratio of the vaporized amounts of substances is performed by configuring the susceptor, as well as configuring a thermal coupling between the two substances such as to generate an efficient reaction stoichiometry of the nicotine vapour and the vapour of the second substance to produce aerosol. Preferably, the reaction stoichiometry is controlled such that a consistent nicotine delivery is provided to a user. Preferably, the reaction stoichiometry is controlled such that no unreacted nicotine vapour or unreacted second substance vapour is delivered to a user.

The method may further comprise the step of arranging the two substances in two separate compartments, that is, in two physically distinct compartments. The two substances are not in physical contact with each other when in the compartments, for example, two compartments comprised in a cartridge. Preferably, the susceptor is arranged in one of the two compartments, preferably in physical contact with the one of the two substances arranged in that compartment.

Further advantages and aspects of the method have already been describes relating to the aerosol-generating system according to the invention and the aerosol-generating article according to the invention and will not be repeated.

BRIEF DESCRIPTION OF THE DRAWINGS

The invention is further described with regard to embodiments, which are illustrated by means of the following drawings, wherein.

DETAILED DESCRIPTION

Figure 1:
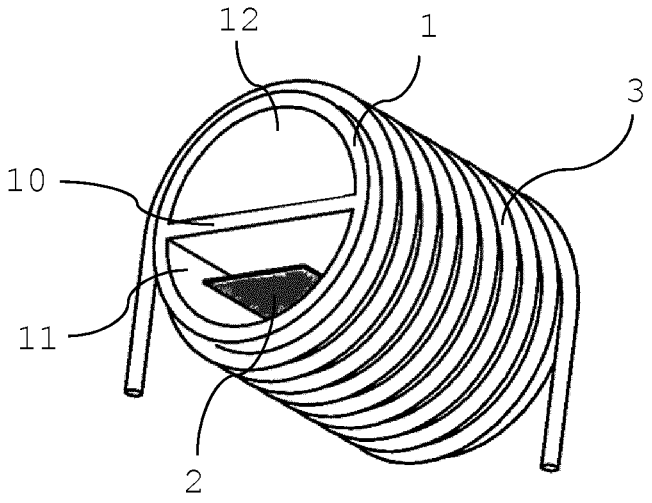
FIG. 1 shows a perspective view of a two-compartment cartridge with circumferentially arranged inductor coil winding.
Figure 2:
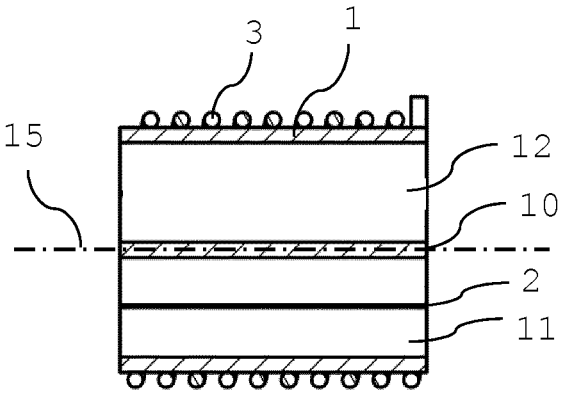
FIG. 2 shows a longitudinal cross section through the cartridge of FIG. 1.
Figure 3:
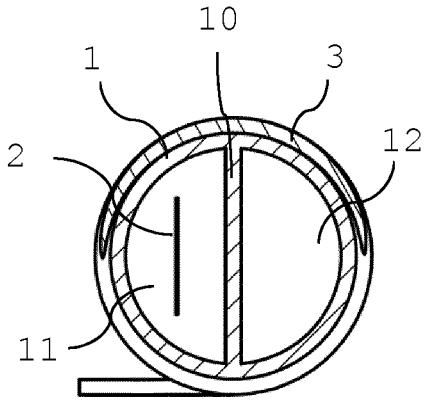
FIG. 3 shows a transverse cross section through the cartridge of FIG. 1.

In FIG. 1 to FIG. 3 a cartridge with a tubular housing 1 is illustrated. The housing 1 is divided by a separation wall 10 into two chambers of semi-circular transverse cross-section 11,12 disposed on either side of the separation wall 10. The chambers 11,12 extend longitudinally between the opposed substantially planar end faces of the cartridge. One of the two chambers forms the first compartment 11 comprising the nicotine source. The other of the two chambers forms the second compartment 12 comprising the second source, for example lactic acid source.

The separation wall 10 extends along the major axis 15 of the cartridge. The nicotine source may comprise a sorption element (not shown), such as a porous plastic sorption element, with nicotine adsorbed thereon, which is arranged in the chamber forming the first compartment 11. The second substance source may comprise a sorption element (not shown), such as a porous plastic sorption element, with lactic acid adsorbed thereon, which is arranged in the chamber forming the second compartment 12.

A susceptor 2 is arranged longitudinally within and along the first compartment 11. The susceptor 2 is shaped as susceptor strip, for example, as metal strip. The strip is arranged in a central portion of the first compartment 11. In the embodiment shown in FIGS. 1 to 3, the susceptor 2 has a length, which corresponds to the length of the cartridge, as may best be seen in FIG. 2.

The separation wall 10 is made of thermally conductive material, while the tubular housing 1 may be made of thermally conducting or thermally insulating material. The thermally conductive material of the separation wall 10 supports heat transfer from the first compartment 11, where the susceptor 2 acts as heating element to the second compartment not comprising a separate heating element.

Preferably, the separation wall 10 is made of a metal or thermally conductive metal alloy.

The housing 1 may be made of thermally insulating polymer materials. Preferably, the tubular housing 1 is made of thermally insulating polymer material.

The cartridge is surrounded by an inductor in the form of a single induction coil 3 for inducing heat in the susceptor 2 arranged in the first compartment 11.

Preferably, the induction coil 3 is part of an aerosol-generating device. The cartridge or the susceptor 2 of the cartridge, respectively, are brought into proximity with the coil 3 by insertion of the cartridge into a cavity of the device provided for receiving the cartridge.

The susceptor 2 may also be arranged in the second compartment 12, instead of the first compartment 11, such that a second substance is heated by the susceptor 2 and a nicotine source is heated by heat conduction from the first compartment 11 through the separation wall 10.

Figure 4:
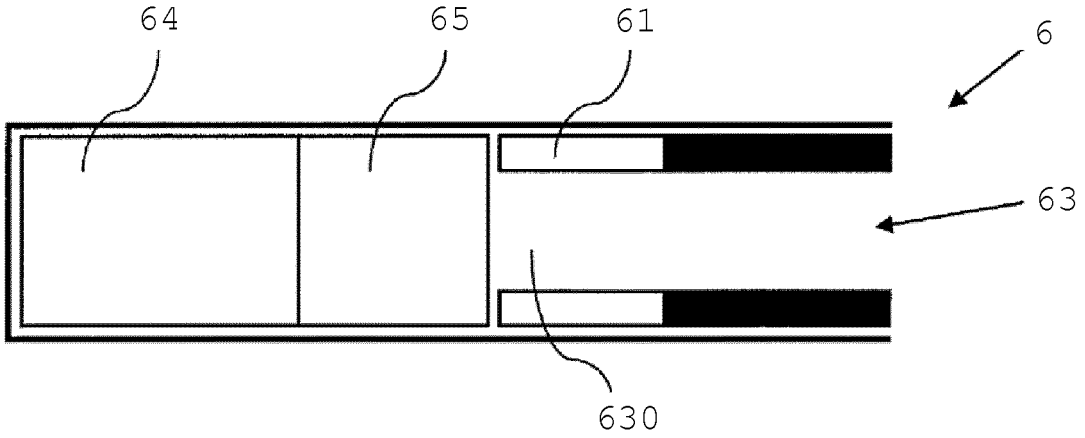
FIG. 4 schematically shows an aerosol-generating device for use in the aerosol-generating system according to the invention.

A schematic longitudinal cross-sectional illustration of an electrically-operated aerosol-generating device 6 is shown in FIG. 4. The aerosol-generating device 6 comprises an inductor 61, for example an induction coil 3. The inductor 61 is located adjacent a distal portion 630 of cartridge receiving chamber 63 of the aerosol-generating device 6. In use, the user inserts an aerosol-generating article comprising a cartridge, for example as described in FIG. 1 to FIG. 3, into the cartridge receiving chamber 630 of the aerosol-generating device 6 such that the susceptor 2 in the cartridge of the aerosol-generating article is located adjacent to the inductor 61.

The aerosol-generating device 6 comprises a battery 64 and electronics 65 that allow the inductor 61 to be actuated. Such actuation may be manually operated or may occur automatically in response to a user drawing on an aerosol-generating article inserted into the cartridge receiving chamber 63 of the aerosol-generating device 6.

When actuated, a high-frequency alternating current is passed through coils of wire that form part of the inductor 61. This causes the inductor 61 to generate a fluctuating electromagnetic field within the distal portion 630 of the cartridge receiving chamber 63 of the device. When an aerosol-generating article is correctly located in the cartridge receiving chamber 63, the susceptor of the article is located within this fluctuating electromagnetic field. The fluctuating field generates at least one of eddy currents and hysteresis losses within the susceptor 2, which is heated as a result. The heated susceptor heats the nicotine source (or second substance source, whichever compartment the susceptor 2 is arranged in). Subsequently, through heat conduction also the second substance source (or nicotine source) of the aerosol-generating article is heated to a sufficient temperature to form an aerosol. Different temperatures may be achieved in the first and the second compartment 11,12 according to an extent of heat conduction and heat loss in the cartridge.

The aerosol generated by heating the two sources is drawn downstream through the aerosol-generating article, for example versus the direction of and trough a mouthpiece and may be inhaled by a user.

The invention claimed is:

1. An aerosol-generating system comprising:

an aerosol-generating article comprising two substance sources including a nicotine source and a second substance source, a cartridge comprising a first compartment comprising the nicotine source and a second compartment comprising the second substance source, wherein the first compartment and the second compartment are arranged in parallel within the cartridge, a susceptor to heat any one of the two substance sources and being arranged in any one of the first compartment or the second compartment; and a power source connected to a load network, the load network comprising an inductor to be inductively coupled to the susceptor, wherein the two substance sources are thermally coupled such that the other one of the two substance sources not heated by the susceptor is heatable by heat transfer from the one of the two substance sources that is heated by the susceptor by heat transfer from the compartment in which the susceptor is arranged to the other compartment.

2. The aerosol-generating system according to claim 1, wherein the susceptor is configured to heat the one of the two substance sources to a first temperature, and wherein a thermal coupling of the two substance sources is configured such that the other one of the two substance sources not heated by the susceptor is heatable by heat transfer to a second temperature, the second temperature being lower than the first temperature.

3. The aerosol-generating system according to claim 1, wherein the susceptor is in direct contact with the one of the two substance sources that is heated by the susceptor.

4. The aerosol-generating system according to claim 1, wherein the second substance source is a lactic acid source or pyruvic acid source and an aerosol generated in the aerosol-generating system comprises nicotine salt particles.

5. The aerosol-generating system according to claim 1, wherein the cartridge further comprises a third compartment comprising an aerosol-modifying agent source.

6. The aerosol-generating system according to claim 1, wherein the cartridge is cylindrical and one or both of opposed planar end faces of the cartridge is sealed by one or more frangible or removable barriers.

7. The aerosol-generating system according to claim 1, wherein the first compartment and the second compartment each have a semi-circular transverse cross-section.

8. The aerosol-generating system according to claim 1, wherein a length of the susceptor is equal to a length of the cartridge.

9. The aerosol-generating system according to claim 1, wherein the inductor is a single induction coil.

10. An aerosol-generating article comprising a cartridge, the cartridge comprising:

a first compartment comprising a nicotine source;

a second compartment comprising a second substance source;

a susceptor arranged in any one of the first compartment or the second compartment, wherein the first compartment and the second compartment are arranged in parallel in the cartridge, and wherein the susceptor is arranged in a central portion of the first compartment or of the second compartment.

11. The aerosol-generating article according to claim 10, wherein the susceptor is an elongate susceptor.

12. The aerosol-generating article according to claim 10, the cartridge comprising a separation wall separating the first compartment from the second compartment, wherein the separation wall comprises thermally conductive material.

13. The aerosol-generating article according to claim 11, wherein the elongate susceptor is in the shape of a susceptor rod.

14. An aerosol-generating article comprising a cartridge, the cartridge comprising:

a first compartment comprising a nicotine source;

a second compartment comprising a second substance source;

a susceptor arranged in any one of the first compartment or the second compartment, wherein the first compartment and the second compartment are arranged in parallel in the cartridge, and wherein an outer cartridge wall comprises thermally insulating material.

15. The aerosol-generating article according to claim 14, wherein the susceptor is an elongate susceptor.

16. The aerosol-generating article according to claim 14, the cartridge comprising a separation wall separating the first compartment from the second compartment, wherein the separation wall comprises thermally conductive material.

17. A method for controlling a reaction stoichiometry between nicotine vapour and a second substance vapour in an aerosol-generating system for generation of aerosol comprising nicotine, the method comprising: providing two substances including nicotine and a second substance;

arranging the two substances in two separate, thermally coupled compartments arranged in parallel;

providing a susceptor;

arranging the susceptor in one of the two compartments;

heating one of the two substances to a first temperature by the susceptor;

generating a temperature gradient between the two substances; and heating the other one of the two substances to a second temperature through heat transfer from the one substance heated by the susceptor by heat transfer from the compartment in which the susceptor is arranged to the other compartment, wherein the second temperature is lower than the first temperature, thereby controlling a ratio of a vaporized amount of nicotine and vaporized amount of second substance.

18. An aerosol-generating article comprising a cartridge, the cartridge comprising:

a first compartment comprising a nicotine source;

a second compartment comprising a second substance source;

a susceptor arranged in any one of the first compartment or the second compartment, wherein the first compartment and the second compartment are arranged in parallel in the cartridge, wherein the cartridge comprises a separation wall separating the first compartment from the second compartment, wherein the separation wall comprises thermally conductive material, and wherein the separate wall is made of a metal or thermally conductive metal alloy.

19. The aerosol-generating article according to claim 18, wherein the susceptor is an elongate susceptor.

* * * * *